US008054185B2

(12) United States Patent
Lian et al.

(10) Patent No.: US 8,054,185 B2
(45) Date of Patent: Nov. 8, 2011

(54) OPTIMIZATION OF THE FIELD PROFILE ON A HIGH FIELD STRENGTH MAGNETIC DETACHER

(75) Inventors: Ming-Ren Lian, Boca Raton, FL (US); Wing K. Ho, Boynton Beach, FL (US); Ronald Joseph Davis, Lake Worth, FL (US); William Johnson, III, Lake Worth, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 462 days.

(21) Appl. No.: 12/419,623

(22) Filed: Apr. 7, 2009

(65) Prior Publication Data

US 2010/0148969 A1 Jun. 17, 2010

Related U.S. Application Data

(60) Provisional application No. 61/203,060, filed on Dec. 17, 2008.

(51) Int. Cl.
*G08B 13/14* (2006.01)

(52) U.S. Cl. ..... 340/572.9

(58) Field of Classification Search ..... 340/572.9, 340/572.1–572.8; 70/57.1; 24/303; 335/306
See application file for complete search history.

(56) References Cited

U.S. PATENT DOCUMENTS 5,955,951 A * 9/1999 Wischerop et al. ..... 340/572.8
5,959,520 A 9/1999 Stelter et al.
7,148,805 B2 * 12/2006 Hogan ..... 340/572.9
7,523,630 B2 * 4/2009 Skjellerup ..... 70/57.1
7,750,806 B1 * 7/2010 Skjellerup et al. ..... 340/568.1
7,817,041 B2 * 10/2010 Skjellerup et al. ..... 340/572.1
7,921,524 B2 * 4/2011 Maurer ..... 24/303
2006/0070410 A1 * 4/2006 Fuss et al. ..... 70/57.1
2006/0070411 A1 * 4/2006 Ho et al. ..... 70/57.1
2007/0125140 A1 6/2007 Ho
2007/0182569 A1 8/2007 Lynce et al.
2008/0246574 A1 10/2008 Ho

FOREIGN PATENT DOCUMENTS

DE 102007002065 A1 7/2008
WO 2007/064339 A1 6/2007

OTHER PUBLICATIONS

International Search Report and Written Opinion dated Sep. 2, 2009 for International Application No. PCT/US2009/002620, International Filing Date Apr. 28, 2009 consisting of 12-pages.

* cited by examiner

*Primary Examiner* — Phung Nguyen
(74) *Attorney, Agent, or Firm* — Alan M. Weisberg; Christopher & Weisberg, P.A.

(57) ABSTRACT

A magnetic detacher has a core magnet and a ring magnet. The core magnet has a body with a top and bottom surface, and produces a first magnetic field. The ring magnet defines a cavity. The ring magnet has a body with a top and bottom and produces a second magnetic field. The ring magnet is axially aligned with the core magnet such that the first magnetic field opposes the second magnetic field along the bodies and enhances it within the cavity. The top surface of the core magnet is separated from the bottom surface of the ring magnet by a predetermined distance thereby producing a resultant magnetic field having a first resultant field strength at a specific position greater than a second resultant field strength produced at the same position when the top surface of the core magnet abuts the bottom surface of the ring magnet.

20 Claims, 8 Drawing Sheets

OPTIMIZATION OF THE FIELD PROFILE ON A HIGH FIELD STRENGTH MAGNETIC DETACHER

CROSS-REFERENCE TO RELATED APPLICATION

This application is related to and claims priority to U.S. Provisional Patent Application No. 61/203,060, entitled "OPTIMIZATION OF THE FIELD PROFILE ON A HIGH FIELD STRENGTH MAGNETIC DETACHER," filed Dec. 17, 2008, the entire contents of which is incorporated herein by reference.

STATEMENT REGARDING FEDERALLY SPONSORED RESEARCH OR DEVELOPMENT n/a

FIELD OF THE INVENTION

The present invention relates generally to a detachment method and magnetic detacher for electronic article surveillance ("EAS") tags and more specifically to a method and system for optimizing the field profile of a high strength magnetic detacher.

BACKGROUND OF THE INVENTION

Electronic Article Surveillance ("EAS") systems are designed to prevent unauthorized removal of an item from a controlled area. A typical EAS system may include a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area. A security tag is deactivated before a tagged item can leave the controlled area without triggering the alarm.

As is known in the art, security tags (also referred to as labels) for EAS systems can be constructed in any number of configurations. The desired configuration of the tag or label is often dictated by the nature of the article to be protected. For example, an EAS label may be enclosed in a rigid housing which can be secured to the monitored item, such as hard tags containing EAS labels which are commonly attached to clothing in retail stores. Some EAS hard tags typically include a plastic tag body which houses an EAS sensor and a locking mechanism including a pin or tack which passes through the item and is clamped to the tag body to secure the item and tag together. Generally, theses tags require a detacher unit to remove the tack from the tag body and allow the item to be separated from the tag. In some applications, a detacher unit may include a magnet assembly which applies a magnetic field to the tag body for releasing the tack.

FIG. 1 illustrates a prior art EAS tag 10 having a rigid, e.g., plastic, tag body 12 with a hollow internal chamber 14. The tag body 12 houses an EAS sensor 16 for triggering an alarm. The EAS tag 10 includes a tack 18 with an enlarged head 20. As shown, the tack 18 is securely held within the tag body 12 by a magnetic clamping mechanism 22. In order to remove the tack 18, the magnetic clamping mechanism 22 must be disengaged using a magnetic detacher. The plastic tag body 12 includes a substantially circular protrusion 24 of sufficient size to completely encase the tack 18 and magnetic clamping mechanism 22.

FIG. 2 illustrates one conventional magnetic detacher unit 26. The magnetic detacher unit 26 includes a base unit 28 having an indented detaching zone 30 designed to receive protrusion 24 of EAS tag 10 or another magnetic securing device. A high field strength magnet assembly 32, as shown in FIGS. 3 and 4, resides within the base unit 28 and is positioned proximate to the indented detaching zone 28 to present a magnetic field within the detaching zone 30 in order to disengage a magnetic clamping mechanism 22 from a tack 18 of the EAS tag 10, thereby allowing removal of EAS tag 10 or other magnetic securing device from the previously secured item.

As is shown in FIG. 4, a magnet assembly 32 for a magnetic EAS tag detacher is shown. The magnet assembly 32 includes a cylindrical core magnet 34 and an oppositely magnetized ring magnet 36 stacked on top of the cylindrical core magnet 34 in order to maximize the axial magnetic field in proximity of a cavity 38 of the ring magnet 36. In other words, the magnetization of the cylindrical core magnet 34, indicated by field lines 39*a*, is opposite the magnetization of the ring magnet 36, indicated by field lines 39*b* in the body of the ring magnet 36. However, as the magnetic field of the ring magnet 36 radiates from body of the ring, the orientation of the magnetic field is actually rotated 180° when the field passes through the cavity 38. Therefore, within the cavity 38, the effects of the magnetic fields produced by the ring magnet 36 and the core magnet 34 are additive, thereby increasing the resulting field strength inside the cavity 38. As discussed below, using this arrangement, the maximum field strength is not provided at particular or optimal location.

The high field strength magnet assembly 32 includes a cylindrical core magnet 34 and an oppositely magnetized ring magnet 36 stacked on top of the cylindrical core magnet 34 in order to maximize the axial magnetic field in proximity of a cavity 38 of the ring magnet 36. To permit the removal of the tack 18, the protrusion 24 of the EAS tag 10 or other magnetic securing device is inserted into the cavity 38 to take advantage of the strong field inside the ring magnet 36. The magnet assembly 32 provides a substantially vertical magnetic field in the cavity 38 sufficient to force the clamping mechanism 22 to disengage and allow removal of the tack 18 from the tag body 12.

Many different types of magnetic clamping mechanisms 22 are used in a variety of EAS tags and other magnetic securing devices. For example, one such clamping mechanism 22 is shown in FIGS. 5 and 6. In this example, the clamping mechanism 22 consists of a spring 40 used in combination with a clutch 42. The shaft 44 of the tack 18 is inserted into a hollow tube 46 which extends through the protrusion 24 of the plastic tag body 12. The shaft 44 is inscribed with one or more notches 48*a*, 48*b*, 48*c* (referenced collectively as notch 48) which receive the clutch 42 in a locked configuration, thereby preventing the tack 18 from being removed from the plastic tag body 12. When the EAS tag 10 is secured (See FIG. 5), the spring 40 is in an engaged position supporting the clutch 42 and preventing the clutch 42 from moving in a downward direction and disengaging from the notch 48. When the EAS tag 10 or other magnetic securing device is presented with the magnetic field of the magnetic detacher unit 26 (See FIG. 6), the clutch 42, is pulled down and away from the notch 48 and releases the tack 18.

Other magnetic clamping mechanisms 22 may use different locking devices, but the principle operation of the magnetic detacher unit 26 remains the same as described above. To disengage a particular EAS tag 10 or other magnetic securing device, the high field strength magnet assembly 32 must present the needed magnetic field strength at the exact location of the implemented clutch 40. Because the field strength of the magnet assembly 32 decreases quite rapidly as the distance away from the magnet assembly increases, much stronger magnets than needed are often used in constructing the magnetic detacher unit 26. Stronger magnets introduce additional cost into manufacturing the magnetic detacher unit 26.

Additionally, the security tags used in an EAS system are replaced over time due to theft, loss, or normal wear and tear. For example, a sales clerk may forget to remove the EAS tag 10 from a purchased item. The security tags designed to be used in conjunction with a specific EAS system having a particular magnetic detacher unit 26 may be replaced with cheaper, "knock-off" EAS tags often provided by sub-standard manufacturers. These "knock-off" tags may not meet the requirements of the EAS system, provide a risk of unauthorized removal and do not, necessarily, have the magnetic clamping mechanism 22 at the same position of the original manufacturer's EAS tag 10. Often these "knock-off" tags may be easily detached using a single magnet, essentially rendering the protection offered by the EAS system practically worthless.

Therefore, what is needed is a system and method for optimizing the field profile of a high strength magnetic detacher in order to achieve maximum field strength at particular location.

SUMMARY OF THE INVENTION

The present invention advantageously provides a method and system for optimizing the field profile of a high strength magnetic detacher in order to achieve maximum field strength at particular location.

In accordance with one aspect, the present invention provides a magnetic detacher in which a housing defines an inner volume in which is positioned a core magnet and a ring magnet. The core magnet has a body with a top surface and a bottom surface opposite the top surface. The core magnet produces a first magnetic field. The ring magnet defines a cavity having a first diameter. The ring magnet has a top surface, a bottom surface opposite the top surface. The ring magnet produces a second magnetic field and is axially aligned with the core magnet such that the first magnetic field opposes the second magnetic field along the bodies of the respective magnets and enhances the second magnetic field within the cavity. The top surface of the core magnet is separated from the bottom surface of the ring magnet by a predetermined distance to produce a resultant magnetic field having a first resultant field strength at a specific position that is greater than a second resultant field strength produced at the same position when the top surface of the core magnet abuts the bottom surface of the ring magnet.

In accordance with another aspect, the present invention provides a magnet assembly for use in a magnetic detacher in which the magnet assembly has a core magnet has a body with a top surface and a bottom surface opposite the top surface. The core magnet produces a first magnetic field. A ring magnet defines a cavity having a first diameter. The ring magnet has a body with a top surface and a bottom surface opposite the top surface. The ring magnet produces a second magnetic field and is axially aligned with the core magnet such that the first magnetic field opposes the second magnetic field along the bodies of the respective magnets and enhances the second magnetic field within the cavity. The top surface of the core magnet is separated from the bottom surface of the ring magnet by a predetermined distance to produce a resultant magnetic field having a first field strength at a specific position that is greater than a second field strength produced at the same position when the top surface of the core magnet abuts the bottom surface of the ring magnet.

In accordance with yet another aspect, the present invention provides a method for detaching a magnetic securing device from an item. The magnetic securing device is secured by a clutch mechanism engaging a magnetic locking mechanism. The magnetic securing device is received in a magnetic electronic article surveillance tag detacher in which the magnetic electronic article surveillance tag detacher includes a core magnet and a ring magnet. The core magnet has a body with a top surface and a bottom surface opposite the top surface. The core magnet produces a first magnetic field. The ring magnet defines a cavity having a first diameter. The ring magnet has a body with a top surface and a bottom surface opposite the top surface. The ring magnet produces a second magnetic field and is axially aligned with the core magnet such that the first magnetic field opposes the second magnetic field along the bodies of the respective magnets and enhances the second magnetic field within the cavity. The top surface of the core magnet is separated from the bottom surface of the ring magnet by a predetermined distance to produce a resultant magnetic field having a first resultant field strength at a specific position that is greater than a second resultant field strength produced at the same position when the top surface of the core magnet abuts the bottom surface of the ring magnet. The field strength at the specific position disengages the clutch mechanism to release the magnetic locking mechanism.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
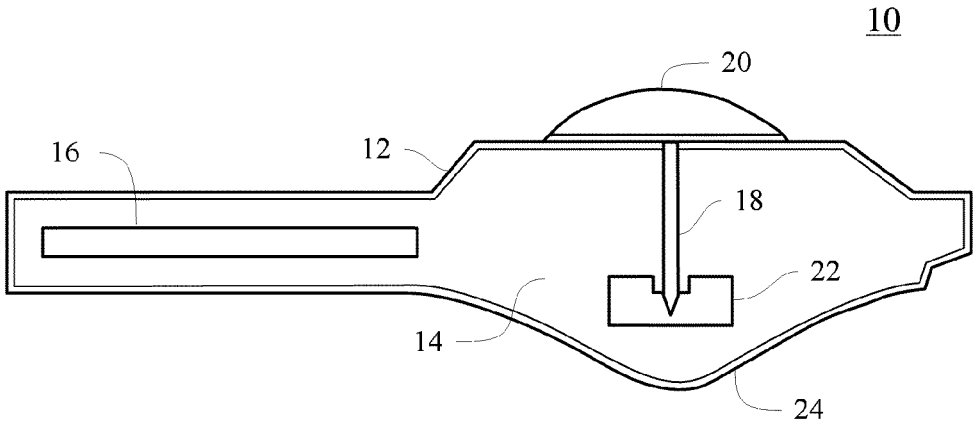
FIG. 1 PRIOR ART
FIG. 1 is a side view of a prior art electronic article surveillance ("EAS") tag with a magnetic locking mechanism.
Figure 2:
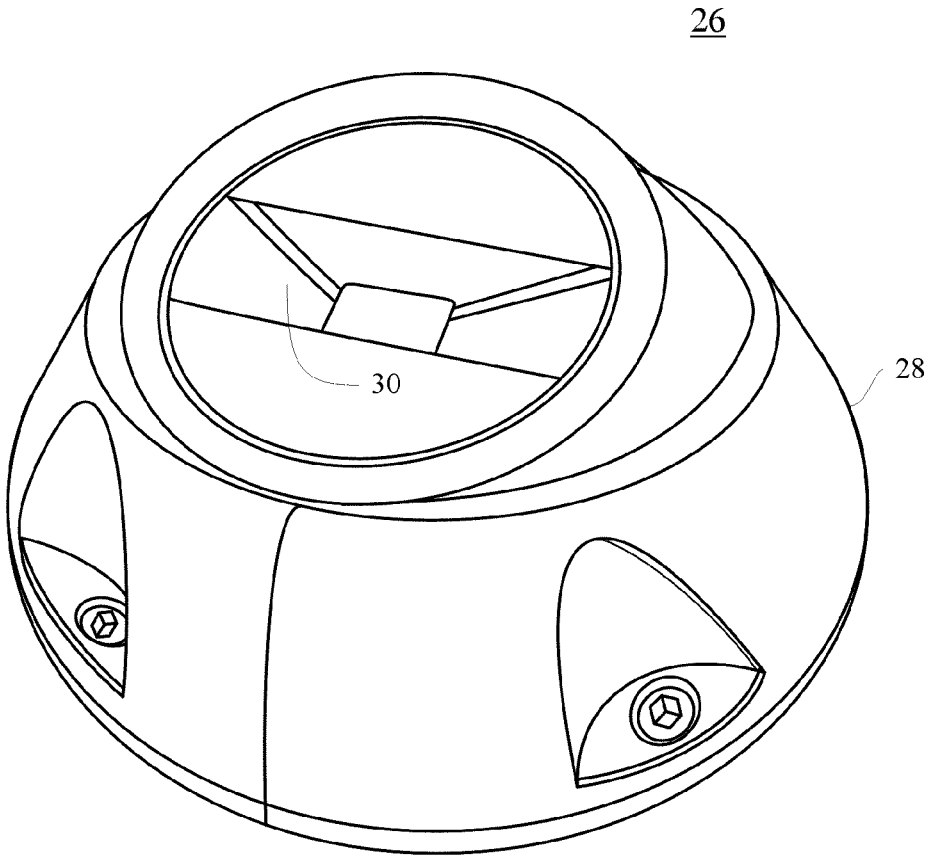
FIG. 2 PRIOR ART
FIG. 2 is a perspective view of a prior art magnetic EAS detacher unit.
Figure 3:
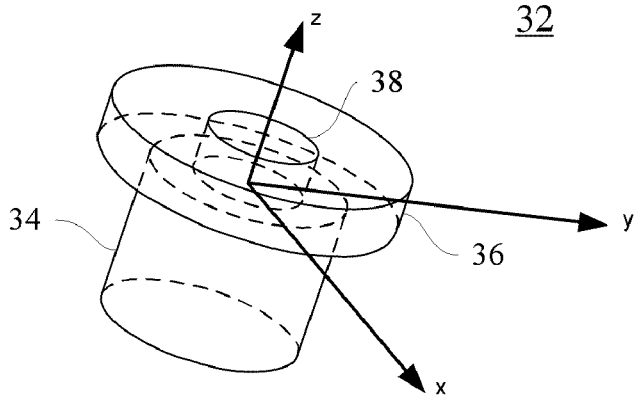
FIG. 3 PRIOR ART
FIG. 3 is a perspective view of a prior art magnet assembly for an EAS detacher unit.
Figure 4:
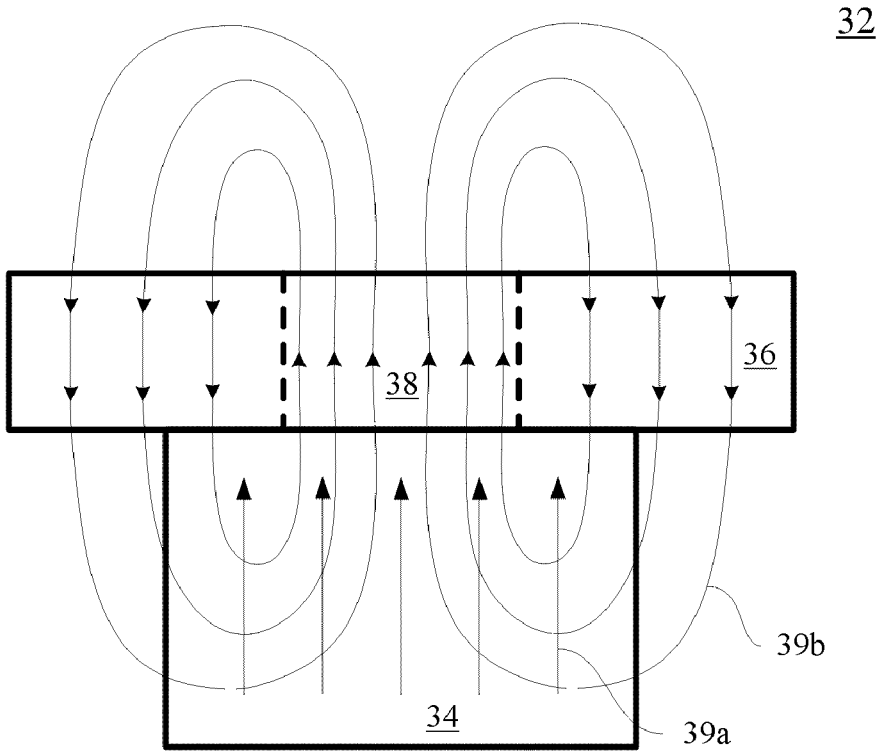
FIG. 4 PRIOR ART
FIG. 4 is a side view of a prior art magnet assembly for an EAS detacher unit illustrating magnetic field orientation of each magnetic component.

Before describing in detail exemplary embodiments that are in accordance with the present invention, it is noted that the embodiments reside primarily in combinations of apparatus components and processing steps related to implementing a system and method for optimizing the field profile of a high strength magnetic detacher. Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

As used herein, relational terms, such as "first" and "second," "top" and "bottom," and the like, may be used solely to distinguish one entity or element from another entity or element without necessarily requiring or implying any physical or logical relationship or order between such entities or elements.

One embodiment of the present invention advantageously provides a method and system for fine-tuning the magnetic field profile of a magnetic assembly in a magnetic detacher unit in order to use the magnetic detacher with a specific mechanical tag design. The use of a spacer element enhances the magnetic field produced within the zone of interest (detaching zone). Additionally, a booster element constructed from, for example, soft ferromagnetic material, aids in enhancing the magnetic field further out into the detaching zone.

In another embodiment, a magnetic shield element with a similar foot print as the ring magnet may also help condense the field into the cavity of the detacher unit. A shield element with a thickness of only a fraction of millimeter also effectively reduces the stray field to the outside environment. This shielding minimizes the possibility of destroying magnetic cards (such as credit card, gift card, etc.) or attracting other ferrous objects, such as tools, cook wares, etc.

Figure 7:
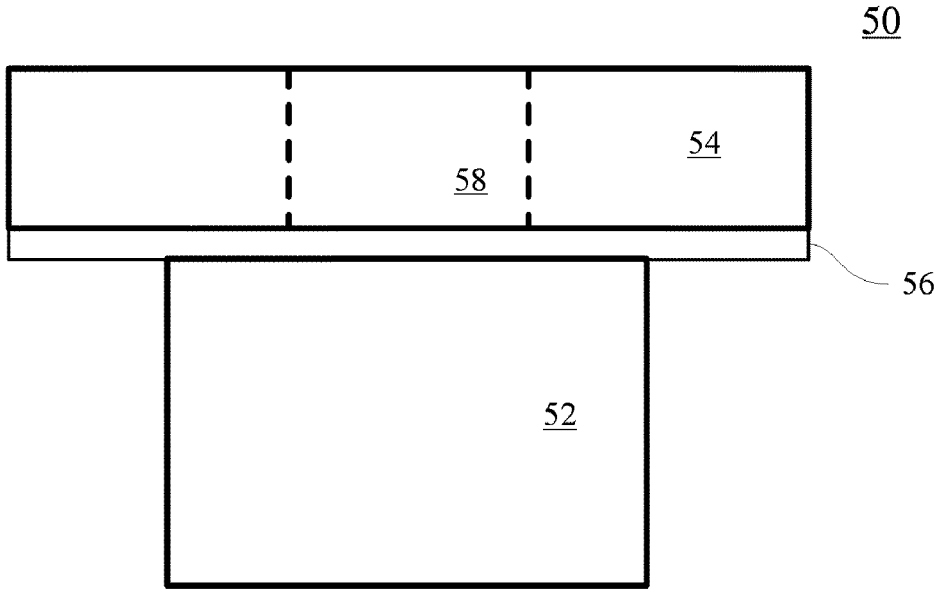
FIG. 7 is a side view of a magnet assembly for an EAS detacher unit constructed in accordance with the principles of the present invention.

Referring now to the drawing figures in which like reference designators refer to like elements, there is shown in FIG. 7, an exemplary magnetic assembly of a magnetic detacher unit provided in accordance with the principles of the present invention and designated generally as 50. Although discussed below in relation to one embodiment for use with a magnetic EAS tag 10 having a magnetic clutch and pin, the principles of the present invention may be used with any magnetic securing device, including but not limited to, keepers, savers, EAS tags, pinless EAS tags, bottle EAS tags, etc. Magnet assembly 50 includes a cylindrical core magnet 52 which is separated from an oppositely magnetized ring magnet 54 by a spacer 56 which aids in projecting the resultant magnetic field further out into the detaching zone. The ring magnet 54 includes a central cavity 58 and is axially aligned with the core magnet 52 and the spacer 56. Although shown as a cylindrical magnet, the geometric shape of the core magnet and the ring magnet are not essential to the spirit of the present invention. In other words, the core magnet and the ring magnet may be any shape, e.g., elliptical, rectangular, cuboidal, cylindrical, etc., as long as the ring magnet includes a central cavity portion which resides atop the core magnet.

Figure 5:
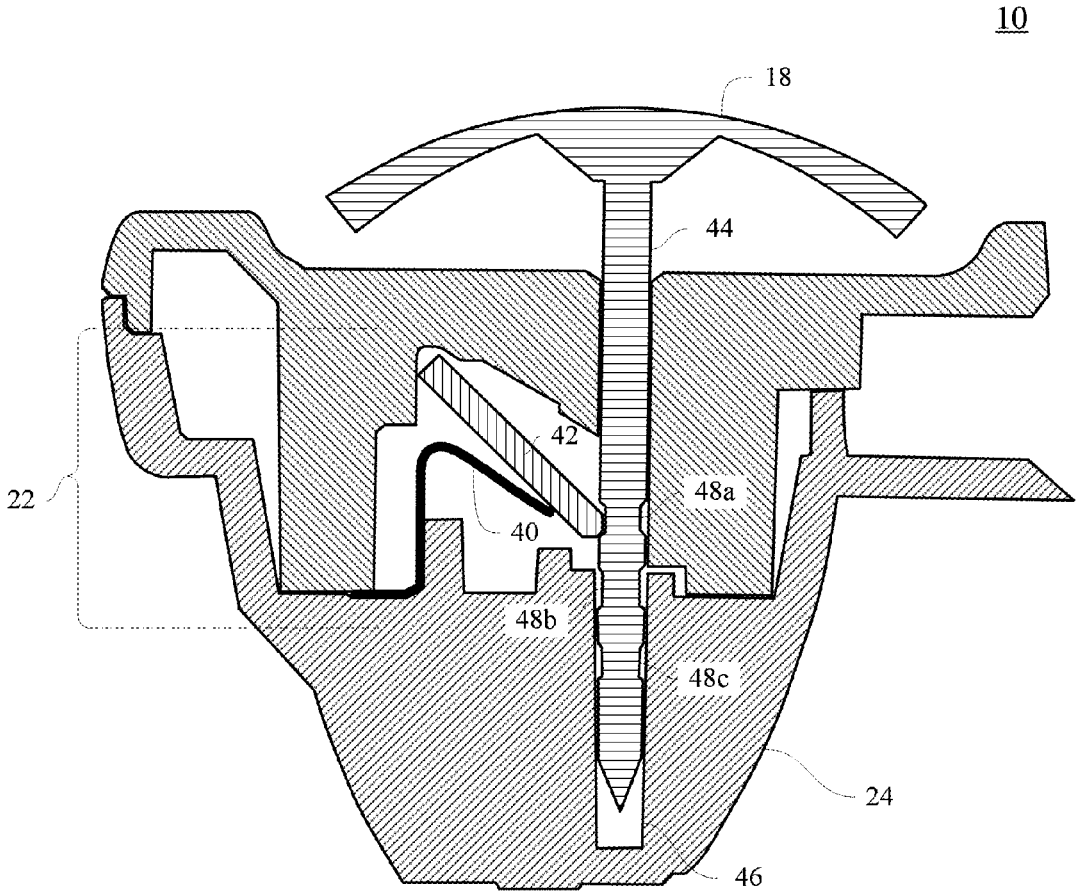
FIG. 5 PRIOR ART
FIG. 5 is a cross-sectional view of a prior art magnetic locking mechanism of an EAS tag in a locked position.
Figure 6:
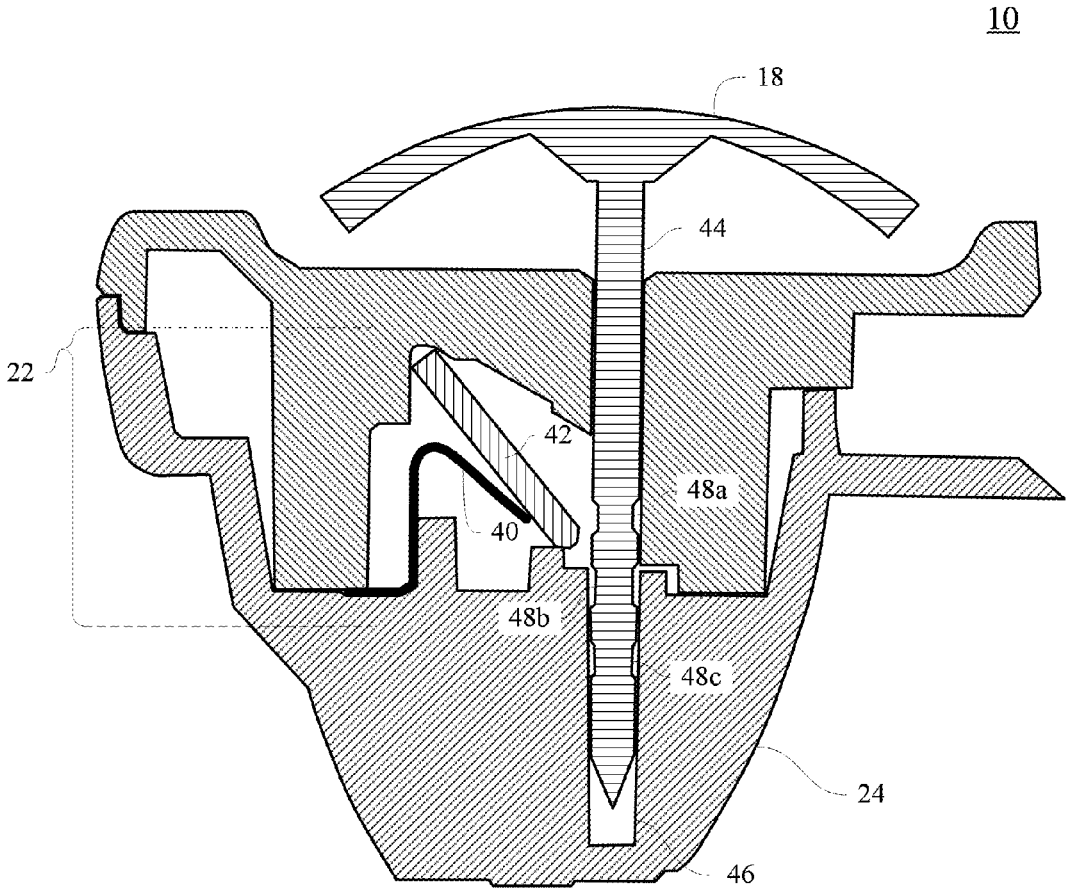
FIG. 6 PRIOR ART
FIG. 6 is a cross-sectional view of a prior art magnetic locking mechanism of an EAS tag in an open position.

The spacer 56 may be constructed preferably from non-ferrous materials, for example, plastic, cloth, etc. Alternatively, the ring magnet 54 and the core magnet 52 may be secured in the magnetic detacher unit such that they are separated from each other by an air gap. The spacer 56 may include a cavity (not shown) having a diameter equal to the diameter of the cavity 58 in the ring magnet 54 in order to accommodate insertion of the protrusion 24 on EAS tag 10 (see FIGS. 1, 5 and 6) or other magnetic securing device. The resulting magnetic field strength of the magnet assembly is dependent upon the separation distance between the ring magnet 54 and the core magnet 52, e.g., the height of the spacer.

In accordance with the present invention, for any specific magnetic EAS tag 10 or other magnetic securing device, a spring 40 (FIGS. 5 and 6) may be designed in such a way that the clutch 42 is responsive to a minimum magnetic field strength at a specific height. This feature allows for the design of more robust EAS tags 10 which cannot be removed from a protected article except by using its corresponding magnetic detacher unit 50. As a result, the ring magnet 54 is chosen such that its coercivity is strong enough to sustain its magnetization in the presence of the opposing magnetic field from the core magnet 52. It is possible to have a design such that the diameter of the core magnet 52 equals to the inner diameter of the ring magnet 54. In such a case, the high coercivity of the ring magnet 54 is not as critical.

Figure 8:
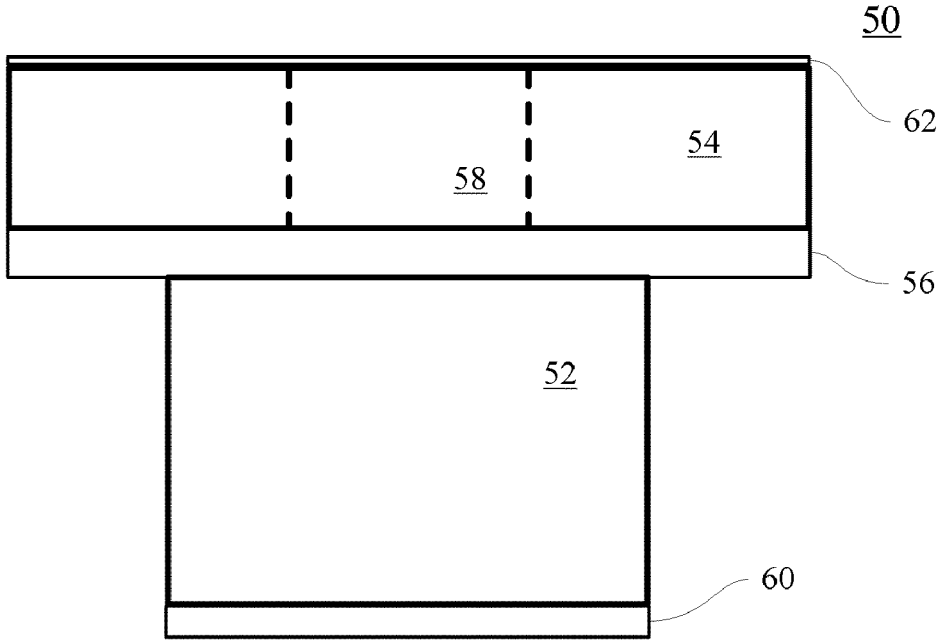
FIG. 8 is a side view of a magnet assembly for an EAS detacher unit having an optional shield and booster unit, constructed in accordance with the principles of the present invention.

Referring now to FIG. 8, an alternative embodiment of the present invention may further include a booster element 60 and/or a shield element 62. The booster element 60 may be constructed of soft ferromagnetic material to further enhance the magnetic field strength of the core magnet 52 and aid in projecting magnetic field further out into the detaching zone. The shield element 62 may have a similar foot print as the ring magnet 54 and may also help condense the magnetic field into the cavity 58 of the magnet assembly 50. A shield element 62 with a thickness of only a fraction of millimeter effectively reduces the stray magnetic field to the outside environment, thereby minimizing the possibility of destroying magnetic cards (such as credit card, gift card, etc.) or attracting other ferrous objects, such as tools, cook wares, etc., be constructed of, for example, steel or other soft ferromagnetic materials.

Figure 9:
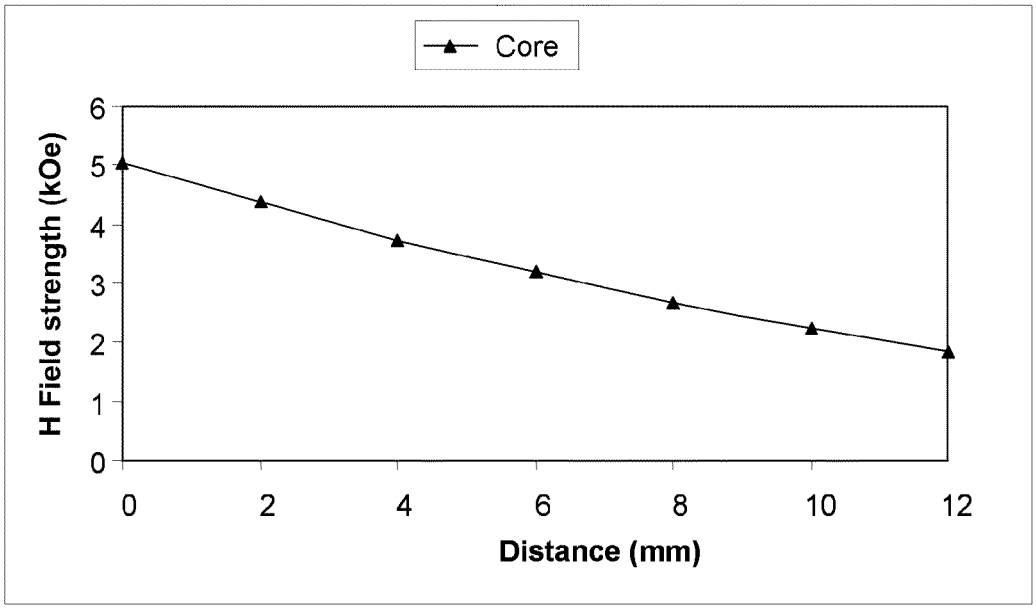
FIG. 9 is a graph illustrating magnetic field strength versus distance for a core magnetic component.
Figure 10:
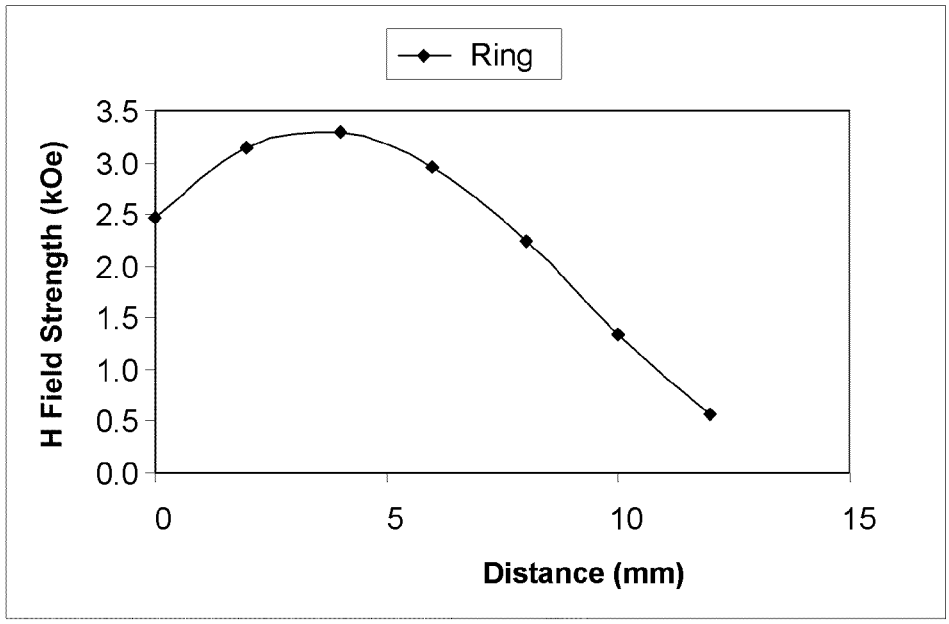
FIG. 10 is a graph illustrating magnetic field strength versus distance for a ring magnetic component in accordance with the principles of the present invention.
Figure 11:
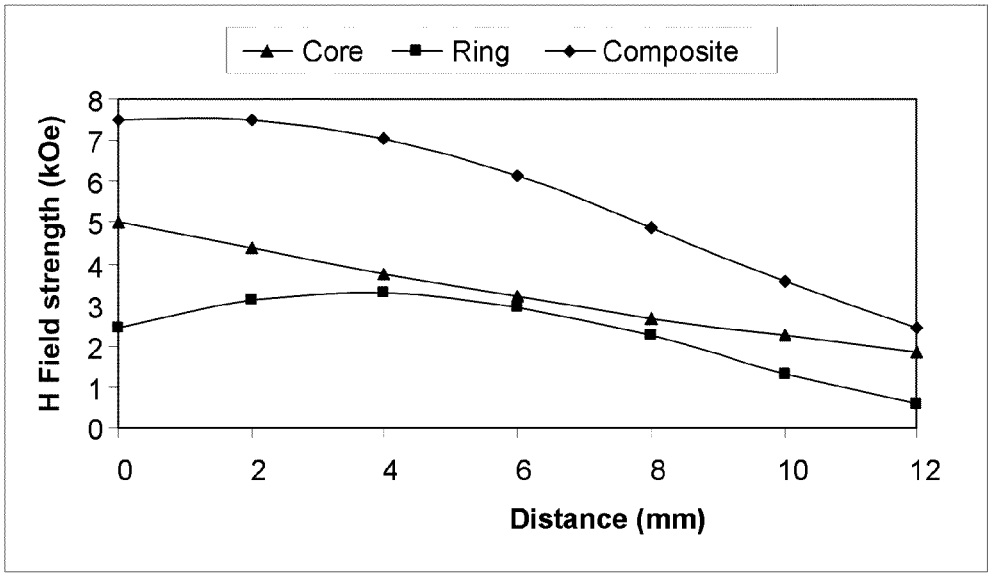
FIG. 11 is a graph illustrating the resulting composite effects of the magnetic field strength versus distance for a magnetic assembly having the ring component abutting the core component.

In FIG. 9, a graph is provided which illustrates the magnetic field strength of a core magnet 52 measured as a function of distance (in millimeters), with the reference point at the top surface of the core magnet 52. FIG. 10 is a graph illustrating the magnetic field strength along the center of a ring magnet 54, also measured as a function of distance (in millimeters), with the reference point at the bottom surface of the ring magnet 54. In the example shown, it should be noted that the magnetic field strength of the ring magnet 54 measured in FIG. 10 peaks at a distance of approximately 4 mm. FIG. 11 is a graph illustrating the resulting composite effects of the magnetic field strength versus distance for a typical magnetic assembly 50 which has the ring component 54 abutting the core component 52, e.g., there is no spacer 56, no air gap, etc. between the ring magnet 54 and the core magnet 52.

As can be seen from FIGS. 9-11, if an EAS tag 10 or other magnetic securing device is designed based on a required magnetic field strength at a distance of less than 4 mm, then no spacing between the core magnet 52 and ring magnet 54 produces the highest magnetic field. However, if an EAS tag 10 or other magnetic securing device using these same magnets needs a magnetic field strength at more than 4 mm height, for example 10 mm, then shifting the magnetic field strength of the ring magnet 36 in relation to the core magnet 34 increases the resultant magnetic field strength inside the cavity 38. Such may be the case where the clutch 42 (FIGS. 5 and 6) is positioned at the 10 mm point.

Figure 12:
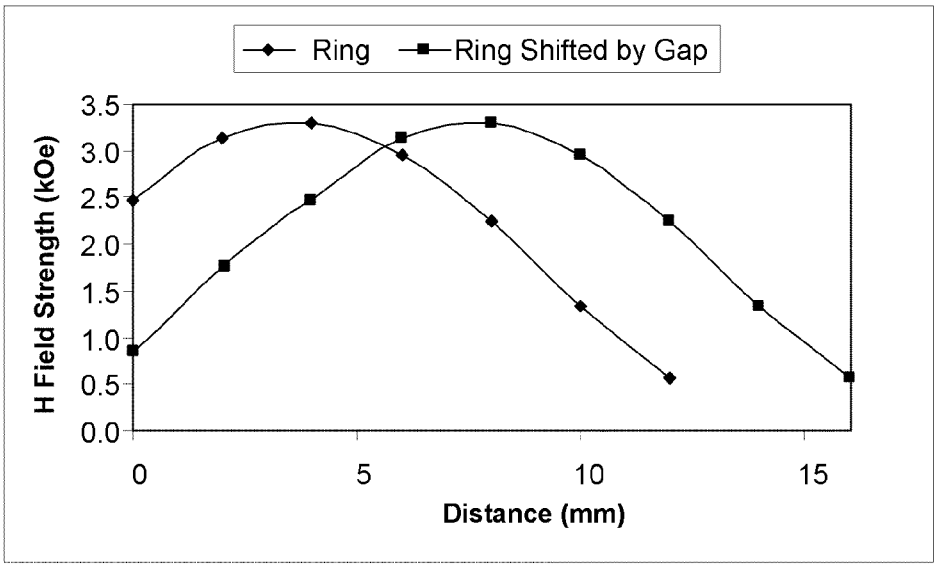
FIG. 12 is a graph illustrating a shifted magnetic field strength versus distance curve for a ring magnetic component displaced by a 4 mm gap in accordance with the principles of the present invention.
Figure 13:
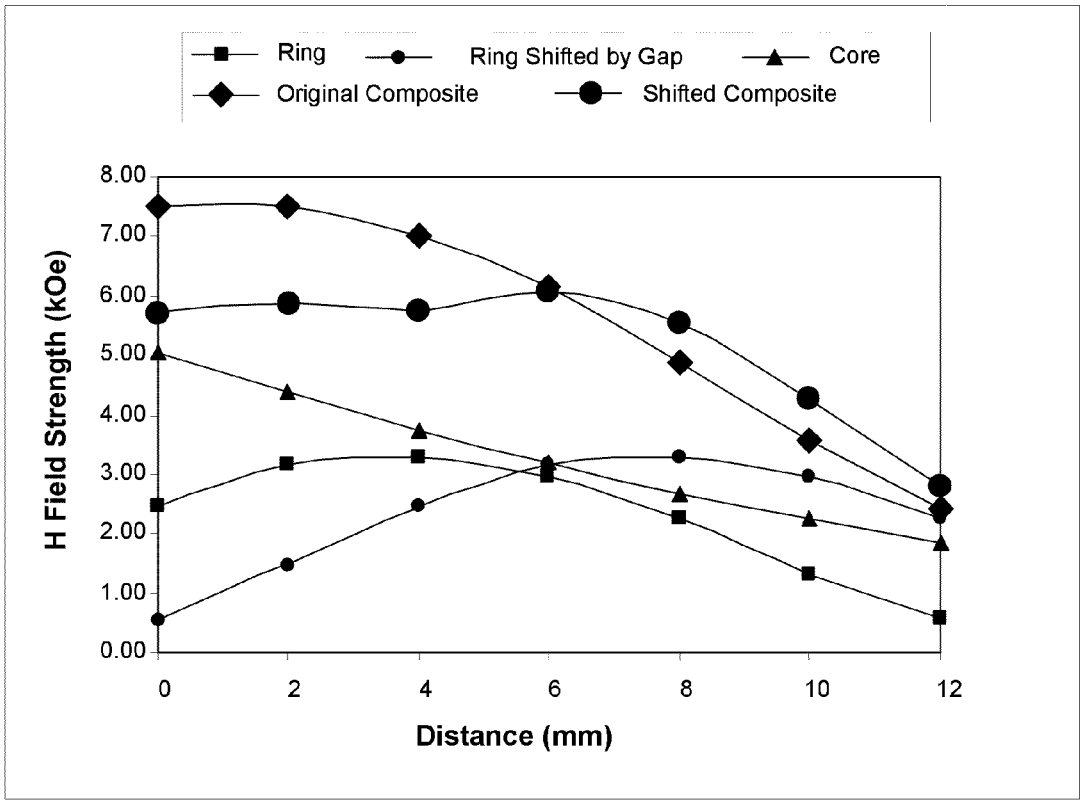
FIG. 13 is a graph illustrating the resulting composite effects of the magnetic field strength versus distance for a magnetic assembly having the ring component displaced by a 2 mm gap in accordance with the principles of the present invention.

FIG. 12 is a graph illustrating the magnetic field strength of a ring magnet 54, offset from the original field strength profile by 4 mm. In other words, a 4 mm spacer 56 is inserted between the ring magnet 54 and the core magnet 52. FIG. 13 is a graph illustrating the resultant field strength produced by the offset ring magnet 54 combined with the core magnet 52. As can be seen from FIG. 13, although the resulting magnetic field is reduced at 4 mm (the top surface of the spacer 54), the magnetic field strength at 10 mm is increased approximately seven hundred Oersted.

Another added benefit for providing a space between the core magnet 52 and the ring magnet 54 is the reduction of the magnetic instability due to the opposing field configuration. A 1 mm spacing reduces the surface magnetic field by about six hundred Oersted, e.g., from 5.5 kOe to about 4.9 kOe seen at the ring magnet 54 surface.

The present invention advantageously tunes the resultant magnetic field strength of magnetic assembly having a combination of a ring magnet and a cylindrical core magnet to provide an optimal magnetic field strength at a predetermined distance away from the surface, e.g., at substantially the location of clutch of the EAS tag or other magnetic securing devices. This feature allows a magnetic assembly of a magnetic detacher e.g., the clutch location, to be tuned to operate only with specifically designed EAS tags or other magnetic securing devices.

Additionally, because the magnetic field strength of the magnet assembly is increased in comparison to prior art magnets, a weaker core magnet may be used to achieve the same field strength previously requiring stronger magnets, thereby reducing the overall cost of the magnet assembly.

Unless mention was made above to the contrary, it should be noted that all of the accompanying drawings are not to scale. Significantly, this invention can be embodied in other specific forms without departing from the spirit or essential attributes thereof, and accordingly, reference should be had to the following claims, rather than to the foregoing specification, as indicating the scope of the invention.

What is claimed is:

1. A magnetic detacher comprising:

a housing defining an inner volume;

a core magnet positioned within the inner volume, the core magnet having a body with a top surface and a bottom surface opposite the top surface, the core magnet producing a first magnetic field; and a ring magnet positioned within the inner volume, a ring magnet defining a cavity having a first diameter, the ring magnet having a body with a top surface and a bottom surface opposite the top surface, the ring magnet producing a second magnetic field and axially aligned with the core magnet such that the first magnetic field opposes the second magnetic field within the bodies of the respective magnets and enhances the second magnetic field within the cavity, the top surface of the core magnet separated from the bottom surface of the ring magnet by a predetermined distance to produce a resultant magnetic field having a first resultant field strength at a specific position greater than a second resultant field strength produced at the same position when the top surface of the core magnet abuts the bottom surface of the ring magnet.

2. The magnetic detacher of claim 1, further comprising a spacer having a height equal to the predetermined distance, the spacer positioned between the top surface of the core magnet and the bottom surface of the ring magnet.

3. The magnetic detacher of claim 2, wherein the spacer is constructed from one of non-ferromagnetic material, plastic and cloth.

4. The magnetic detacher of claim 3, further comprising a shield element, the shield element positioned proximate to the top surface of the ring magnet such that the shield element reduces a stray magnetic field outside the magnetic detacher.

5. The magnetic detacher of claim 4, wherein the shield element defines a first footprint and the ring magnet defines a second footprint, the first footprint being substantially the same as the second footprint.

6. The magnetic electronic article surveillance tag detacher of claim 4, wherein the shield element has a thickness of less than 1 mm.

7. The magnetic detacher of claim 3, further comprising a booster element, the booster element constructed of ferromagnetic material and positioned proximate to the top surface of the ring magnet such that the resultant magnetic field is enhanced.

8. The magnetic detacher of claim 1, wherein the electronic article surveillance tag detacher operates to nest a magnetic securing device for detachment, the magnetic securing device having a protrusion, the diameter of the cavity being greater than an outer diameter of the protrusion such that the cavity operates to receive the protrusion during detachment.

9. The magnetic detacher of claim 8, wherein the magnetic securing device includes a clutch mechanism, a location of the clutch mechanism substantially coinciding with the specific position when the magnetic securing device is nested in the magnetic electronic article surveillance tag detacher.

10. A magnet assembly for use in a magnetic detacher comprising, the magnet assembly comprising:

a core magnet having a body with a top surface and a bottom surface opposite the top surface, the core magnet producing a first magnetic field; and a ring magnet defining a cavity having a first diameter, the ring magnet having a body with a top surface and a bottom surface opposite the top surface, the ring magnet producing a second magnetic field and axially aligned with the core magnet such that the first magnetic field opposes the second magnetic field along the bodies of the respective magnets and enhances the second magnetic field within the cavity, the top surface of the core magnet separated from the bottom surface of the ring magnet by a predetermined distance thereby producing a resultant magnetic field having a first resultant field strength at a specific position greater than a second resultant field strength produced at the same position when the top surface of the core magnet abuts the bottom surface of the ring magnet.

11. The magnet assembly of claim 10, further comprising a spacer having a height equal to the predetermined distance, the spacer positioned between the top surface of the core magnet and the bottom surface of the ring magnet.

12. The magnet assembly of claim 11, wherein the spacer is constructed from one of plastic and cloth.

13. The magnet assembly of claim 10, wherein the magnetic detacher operates to nest a magnetic securing device for detachment, the magnetic securing device having a protrusion, the diameter of the cavity being greater than an outer diameter of the protrusion such that the cavity operates to receive the protrusion during detachment.

14. The magnet assembly of claim 13, wherein the magnetic securing device includes a clutch mechanism, a location of the clutch mechanism substantially coinciding with the specific position when the magnetic securing device is nested in the magnetic detacher.

15. The magnet assembly of claim 10, further comprising a shield having a height equal to the predetermined distance, the shield positioned between the top surface of the core magnet and the bottom surface of the ring magnet such that the shield reduces a stray magnetic field outside the magnetic detacher.

16. The magnet assembly of claim 15 wherein the shield defines a first footprint and the ring magnet defines a second footprint, the first footprint being substantially the same as the second footprint.

17. The magnet assembly of claim 15, wherein the shield element has a thickness less than 1 mm.

18. A method for detaching a magnetic securing device from an item, the magnetic securing device secured by a clutch mechanism engaging a magnetic locking mechanism, the method comprising:

receiving the magnetic securing device in a magnetic detacher, the magnetic detacher including:

a core magnet having a body with a top surface and a bottom surface opposite the top surface, the core magnet producing a first magnetic field; and a ring magnet defining a cavity having a first diameter, the ring magnet having a body with a top surface and a bottom surface opposite the top surface, the ring magnet producing a second magnetic field and axially aligned with the core magnet such that the first magnetic field opposes the second magnetic field along the bodies of the respective magnets and enhances the second magnetic field within the cavity, the top surface of the core magnet separated from the bottom surface of the ring magnet by a predetermined distance thereby producing a resultant magnetic field having a first resultant field strength at a specific position greater than a second resultant field strength produced at the same position when the top surface of the core magnet abuts the bottom surface of the ring magnet; and using the field strength at the specific position to disengage the clutch mechanism to release the magnetic locking mechanism.

19. The method of claim 18, wherein the magnetic detacher further includes a spacer having a height equal to the predetermined distance, the spacer positioned between the top surface of the core magnet and the bottom surface of the ring magnet.

20. The method of claim 18, wherein the magnetic securing device defines a protrusion, the diameter of the cavity being greater than an outer diameter of the protrusion such that the cavity operates to receive the protrusion during detachment.

* * * * *